US009070265B2

(12) United States Patent
Luo et al.

(10) Patent No.: US 9,070,265 B2
(45) Date of Patent: Jun. 30, 2015

(54) SECURITY TAG FOR APPLICATION TO FOOTWEAR

(71) Applicants: Danhui Luo, Lake Worth, FL (US); John C. Ford, Boca Raton, FL (US); Kaley Ford, Boca Raton, FL (US); Thang Tat Nguyen, Boca Raton, FL (US); Charles T. Turgeon, Lighthouse Point, FL (US)

(72) Inventors: Danhui Luo, Lake Worth, FL (US); John C. Ford, Boca Raton, FL (US); Kaley Ford, Boca Raton, FL (US); Thang Tat Nguyen, Boca Raton, FL (US); Charles T. Turgeon, Lighthouse Point, FL (US)

(73) Assignee: Tyco Fire & Security GmbH, Neuhasen Am Rheinfall (CH)

( * ) Notice: Subject to any disclaimer, the term of this patent is extended or adjusted under 35 U.S.C. 154(b) by 110 days.

(21) Appl. No.: 13/972,148

(22) Filed: Aug. 21, 2013

(65) Prior Publication Data

US 2014/0104061 A1 Apr. 17, 2014

Related U.S. Application Data

(60) Provisional application No. 61/691,535, filed on Aug. 21, 2012.

(51) Int. Cl.

| | |
|---|---|
| ***G08B 13/14*** | (2006.01) |
| ***G08B 13/24*** | (2006.01) |
| ***E05B 73/00*** | (2006.01) |
| *E05B 45/00* | (2006.01) |

(52) U.S. Cl.

CPC ..... *G08B 13/2434* (2013.01); *E05B 45/005* (2013.01); *E05B 73/0017* (2013.01); *G08B 13/1445* (2013.01); *E05B 73/0029* (2013.01)

(58) Field of Classification Search

CPC ..... G08B 13/2434; G08B 13/1445; E05B 73/0029; E05B 45/005; E05B 73/0017

USPC ..... 340/572.9

See application file for complete search history.

(56) References Cited

U.S. PATENT DOCUMENTS

| | | | | |
|---|---|---|---|---|
| 2011/0140895 | A1 | 6/2011 | Sayegh et al. | |
| 2012/0304710 | A1 * | 12/2012 | Sayegh et al. | 70/19 |

FOREIGN PATENT DOCUMENTS

| | | | |
|---|---|---|---|
| EP | 1074682 | A1 | 2/2001 |
| FR | 2747203 | A1 | 10/1997 |

* cited by examiner

*Primary Examiner* — Steven Lim
*Assistant Examiner* — Omeed Alizada
(74) *Attorney, Agent, or Firm* — Robert J. Sacco, Esq.; Carol E. Thorstad-Forsyth, Esq.; Fox Rothschild LLP

(57) ABSTRACT

Systems (100) and methods (1500) for operating a security tag (132) of an Electronic Article Surveillance ("EAS") system. The methods involving: attaching a clip (210) to a curved sidewall (202) of an article (102) such that a central body (304) of the security tag is vertically aligned with a central axis of the curved sidewall; maintaining the vertical alignment by locating first and second flanges (306, 502) of the security tag against respective opposing surface areas of the curved sidewall; wrapping a securement member (212) of the security tag around an elongate structure (204) of the article which is offset from the curved sidewall in at least one direction and which protrudes away from a main body (218) of the article; and locking the securement member in a position wrapped around the elongate structure of the article using a mechanical locking mechanism (214) of the security tag.

20 Claims, 14 Drawing Sheets

SECURITY TAG FOR APPLICATION TO FOOTWEAR

CROSS REFERENCE TO RELATED APPLICATIONS

This application is a non-provisional application of U.S. Provisional Application No. 61/691,535 filed on Aug. 21, 2012, which is herein incorporated in its entirety.

STATEMENT OF THE TECHNICAL FIELD

The inventive arrangements relate to security tags used in Electronic Article Surveillance ("EAS") systems. More particularly, the inventive arrangements concern security tags and methods for preventing the unauthorized removal of articles (e.g., footwear) from a given location (e.g., a retail store).

DESCRIPTION OF THE RELATED ART

A typical EAS system in a retail setting may comprise a monitoring system and at least one security tag or label attached to an article to be protected from unauthorized removal. The monitoring system establishes a surveillance zone in which the presence of security tags and/or labels can be detected. The surveillance zone is usually established at an access point for the controlled area (e.g., adjacent to a retail store entrance and/or exit). If an article enters the surveillance zone with an active security tag and/or label, then an alarm may be triggered to indicate possible unauthorized removal thereof from the controlled area. In contrast, if an article is authorized for removal from the controlled area, then the security tag and/or label thereof can be deactivated and/or detached therefrom. Consequently, the article can be carried through the surveillance zone without being detected by the monitoring system and/or without triggering the alarm.

Security tags for EAS systems can be constructed in any number of configurations. The desired configuration of a security tag is often dictated by the nature of the article to be protected. For example, pre-packaged goods which are subject to retail theft (e.g., Compact Discs ("CDs") and small electronic devices) may each contain a security label disposed within its packaging in such a way that the security label is hidden from an onlooker's sight (at least during a pre-purchase period of time). In contrast, non-packaged goods (e.g., clothing, shoes, and purses) may each have a security tag coupled thereto. The security housing comprises a rigid housing in which a security label is disposed. The rigid housing typically includes a pin which is inserted through a portion of the non-packaged good (e.g., the fabric of a piece of clothing) and secured in place via locking mechanism. The security tag cannot be removed from the non-packaged good without destroying the rigid housing, except by using an EAS security tag deactivator/remover.

In the non-packaged good scenario, the article incurs some damage as a result from the pins insertion therethrough. High-end retailers and customers dislike having expensive merchandise (e.g., leather goods) damaged by retail theft deterrent devices. Shoes are especially difficult to protect using devices having pins, as the materials from which the shoes are constructed often suffer permanent damage from the pins.

Shoes present other difficulties for pinned security tags. For example, the materials from which certain shoes are made are often too rigid to insert the pins therein and/or too thick to insert the pins therethrough such that the pins can be locked by the locking mechanisms. Many retailers attempt to secure certain types of shoes using security tags in which the pins and/or lanyard thereof are inserted through lace eyelets or tongue areas of the shoes. This practice is fine for a few shoe types (e.g., sneakers), but the security tags interfere with the fitting and lacing process of the shoes.

Various solutions have been derived from overcoming the above identified problems associated with protecting the unauthorized removal of non-packaged goods from retail stores. One such solution involves using pinless security tags which pinch or clamp the articles between a housing and an arm thereof. An exemplary pinless security tag configured to secure footwear is disclosed in U.S. patent application Ser. No. 12/894,738. One can appreciate that such pinching and clamping applies a compressive force on the article, which may cause damage to the article. Also, if a pinching or clamping force is not provided for securing the pinless security tag to the article, then the security tag can be removed from the article by an unauthorized person. As such, the security tag may not actually prevent the unauthorized removal of the article from the retail store.

SUMMARY OF THE INVENTION

The present invention concerns systems and methods for operating a security tag of an EAS system. The methods involve: attaching a clip to a curved sidewall (e.g., a shoe counter) of an article (e.g., a heeled shoe) such that a central body of the security tag is vertically aligned with a central axis (or vertical seam) of the curved sidewall; and maintaining the vertical alignment by locating first and second flanges of the security tag against respective opposing surface areas of the curved sidewall. The first and second flanges extend away from respective sides of the central body so as to be symmetrical to one another. The first and second flanges are shaped to align closely with an exterior contour of the respective surface areas of the curved sidewall. Thereafter, a securement member of the security tag is wrapped around an elongate structure (e.g., a shoe heel) of the article. The elongate structure is offset from the curved sidewall in at least one direction and protrudes away from a main body of the article. The securement member is formed of a slender length of flexible material. As such, the securement member can include, but is not limited to, a strap, a cable, a rope, or a lanyard. The securement member is locked in a position wrapped around the elongate structure of the article using a mechanical locking mechanism of the security tag. The mechanical locking mechanism may be unlocked via application of a magnetic field thereto.

An exemplary architecture of the security tag will now be described. The security tag comprises a central body and a clip coupled to the central body. The clip is configured to be attached to a curved sidewall of an article (e.g., a shoe counter) such that the central body is vertically aligned with a central vertical axis of the curved sidewall (or vertical seam of a shoe counter). The clip comprises a curved portion that is coupled to a first end of the central body opposed from a second end of the security tag to which the securement member is coupled. The clip further comprises an elongate portion coupled to and extending from the curved portion so as to be adjacent to and parallel with an exterior surface of the central body. The elongate portion is in mutually tensioned arrangement with the exterior surface of the central body such that the sidewall of the article can be gripped therebetween. The elongate portion may be shaped the same as or similar to a shoehorn.

The security tag also comprises first and second flanges configured to maintain the vertical alignment between the security tag and the article. The vertical alignment is maintained when the flanges are located against respective opposing surface areas of the curved sidewall. The flanges extend away from respective sides of the central body so as to be symmetrical to one another. The flanges are sized and shaped to: align closely with an exterior contour of the respective surface areas of the curved sidewall; and/or extend at least partially around a point of intersection of the elongate structure and sidewall of the article (e.g., the shoe heel and shoe counter). The securement member is coupled to the flanges and formed of a slender length of flexible material such that it can be wrapped around the elongate structure of the article (e.g., a shoe heel). A mechanical locking mechanism is provided for locking the securement member in a position wrapped around the elongate structure of the article. The mechanical locking mechanism may be unlocked by an application of a magnetic field thereto.

In some scenarios, the security tag is at least partially formed of a transparent material such that any obstruction to the appearance of the article thereby is minimized. Also, at least one aperture is formed in each of the first and second flanges through which the securement member passes. A security label may be affixed to or disposed within a housing of the security tag. The security label is configured to cause an alarm to be activated when the article to which the security tag is affixed enters a surveillance zone of the EAS system.

BRIEF DESCRIPTION OF THE DRAWINGS

Embodiments will be described with reference to the following drawing figures, in which like numerals represent like items throughout the figures, and in which.

DETAILED DESCRIPTION

Figure 1:
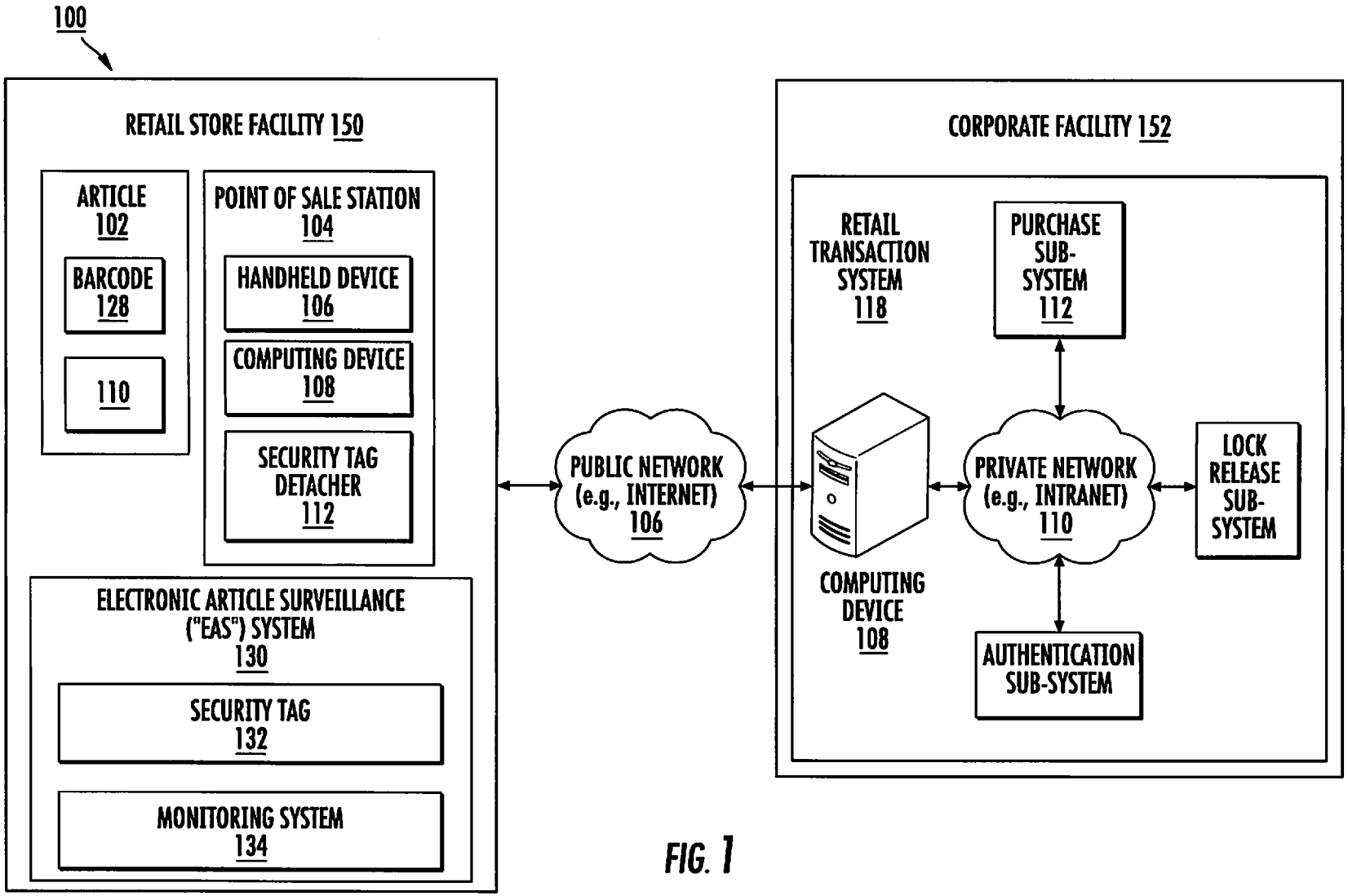
FIG. 1 is a schematic illustration of an exemplary system that is useful for understanding the present invention.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects as illustrative. The scope of the invention is, therefore, indicated by the appended claims. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout the specification may, but do not necessarily, refer to the same embodiment.

Furthermore, the described features, advantages and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment", "an embodiment", or similar language means that a particular feature, structure, or characteristic described in connection with the indicated embodiment is included in at least one embodiment of the present invention. Thus, the phrases "in one embodiment", "in an embodiment", and similar language throughout this specification may, but do not necessarily, all refer to the same embodiment.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

Embodiments will now be described with respect to FIGS. 1-14. Embodiments generally relate to systems and methods for providing an innovative security tag for articles (e.g., footwear) which can be used in an EAS system. In the footwear scenarios, the security tag is configured to be attached to the rear of a shoe, without exerting excessive compression force on the shoe (as is done by many conventional security tags such as those disclosed in the background section of this document). In this regard, the security tag comprises an engagement member designed with a dual purpose of (1) slidingly receiving the counter of a heeled shoe (i.e., the vertical portion of the shoe that wraps around the back of the foot) so as to couple the security tag to the shoe and (2) providing a shoehorn to allow one to comfortably try on the shoe without distraction or annoyance from the security tag. Once coupled to the shoe via the engagement member, the security tag is then securely attached to the shoe by wrapping a strap, cable or lanyard around the heel thereof and locking the strap, cable or lanyard in its wrapped position. Notably, the security tag is not overly visible to the person trying on the shoe. In this regard, it should be appreciated that the security tag is attached to the back of the shoe, and therefore does not obstruct the front view or the side views of the shoe.

Figure 2:
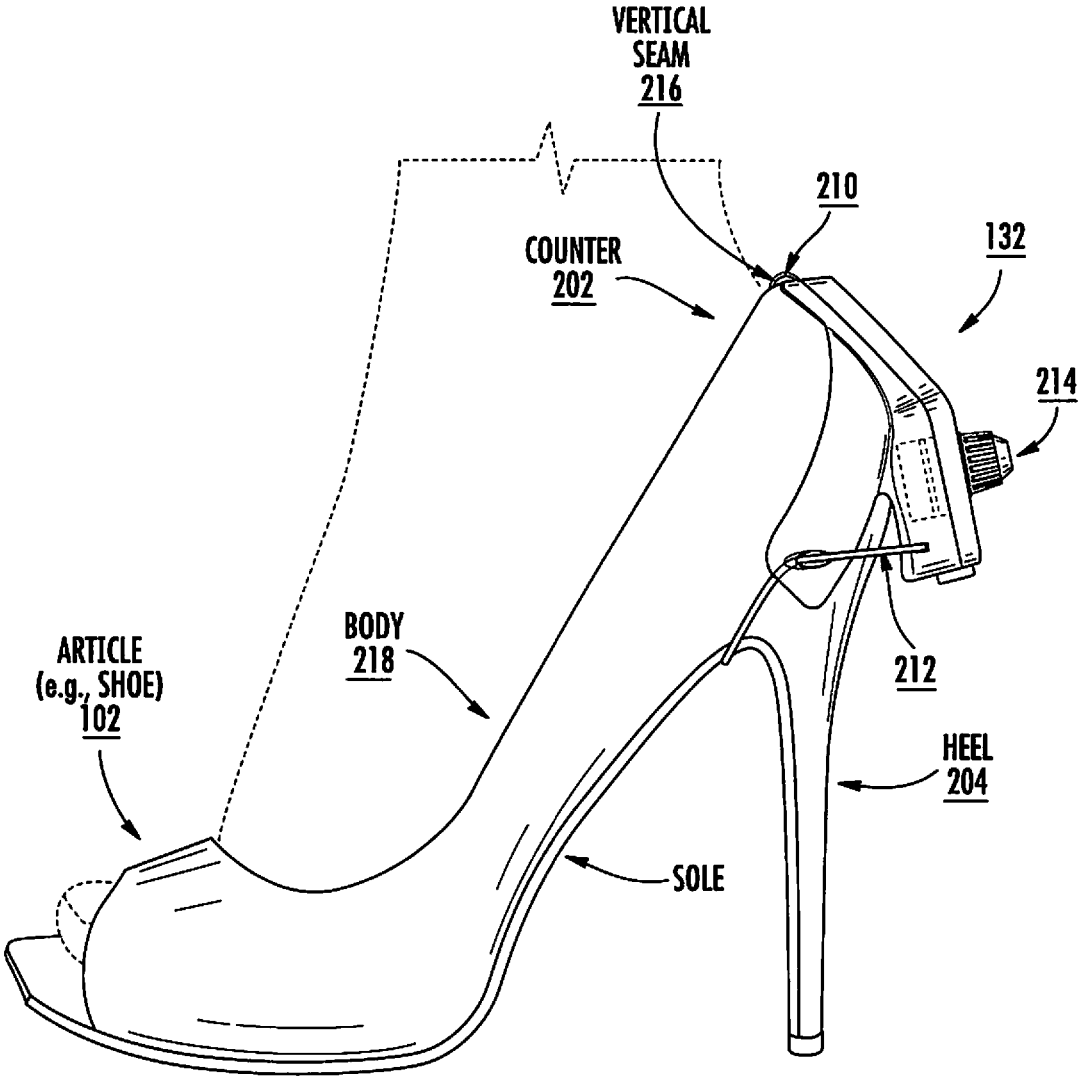
FIG. 2 is schematic illustration of an exemplary security tag secured to an article that is useful for understanding the present invention.

Referring now to FIG. 1, there is provided a schematic illustration of an exemplary system 100 that is useful for understanding the present invention. System 100 comprises a retail store facility 150 including an EAS 130. The EAS 130 comprises a monitoring system 134 and at least one security tag 132. Although not shown in FIG. 1, the security tag 132 is attached to article 102, thereby protecting the article 102 from an unauthorized removal from the retail store facility 150. A schematic illustration of the security tag 132 attached to an article 102 is provided in FIG. 2. As shown in FIG. 2, the article can include, but is not limited to, footwear. The monitoring system 134 establishes a surveillance zone (not shown) within which the presence of the security tag 132 can be detected. The surveillance zone is established at an access point (not shown) for the retail store facility 150. If the security tag 132 is carried into the surveillance zone, then an alarm is triggered to indicate a possible unauthorized removal of article 102 from the retail store facility 150.

During store hours, a customer (not shown) may desire to purchase the article 102. The customer can purchase the article 102 using a Point Of Sale ("POS") station 104. The POS station 104 can include, but is not limited to, a traditional fixed Point Of Sale ("POS") station (e.g., a checkout counter) or a mobile POS station. In either scenario, a retail transaction application executing on a computing device 108 of the POS station 104 facilitates the exchange of data between the article 102, security tag 132, customer, store associate (not shown), and/or Retail Transaction System ("RTS") 118 of a corporate facility 152. For example, after the retail transaction application is launched, a store associate is prompted to start a retail transaction process for purchasing the article 102. The retail transaction process can be started simply by performing a user software interaction, such as depressing a key on a keypad of the computing device 108 or touching a button on a touch screen display of the computing device 108.

Subsequently, the store associate may manually input into the retail transaction application article information. Alternatively or additionally, the store associate may place a handheld device 106 of the POS station 104 in proximity of article 102. As a result of this placement, the POS station 104 obtains article information from the article 102. The article information includes any information that is useful for purchasing the article 102, such as an article identifier and an article purchase price. In some scenarios, the article information may even include an identifier of the security tag 132 attached thereto. The article information can be communicated from the article 102 to the handheld device of the POS station 104 via a short range communication, such as a barcode communication or a Near Field Communication ("NFC").

In the barcode scenario, article 102 has a barcode 128 attached to an exposed surface thereof. The term "barcode", as used herein, refers to a pattern or symbol that contains embedded data. Barcodes may include, for example, one-dimensional barcodes, two dimensional barcodes (such as matrix codes, Quick Response ("QR") codes, Aztec codes and the like), or three-dimensional bar codes. The embedded data can include, but is not limited to, a unique identifier of the article 102 and/or a purchase price of article 102. The barcode 128 is read by a barcode scanner/reader (not shown in FIG. 1) of the POS station 104. Barcode scanners/readers are well known in the art. Any known or to be known barcode scanner/reader can be used herein without limitation.

In the NFC scenarios, article 102 may comprise an NFC enabled device 110. The NFC enabled device 110 can be separate from security tag 132 or comprise security tag 132. An NFC communication occurs between the NFC enabled device 110 and the handheld device 106 over a relatively small distance (e.g., N centimeters or N inches, where N is an integer such as twelve). The NFC communication may be established by touching components 102, 106 together or bringing them in close proximity such that an inductive coupling occurs between inductive circuits thereof. In some scenarios, the NFC operates at 13.56 MHz and at rates ranging from 106 kbit/s to 848 kbit/s. The NFC may be achieved using NFC transceivers configured to enable contactless communication at 13.56 MHz. NFC transceivers are well known in the art, and therefore will not be described in detail herein. Any known or to be known NFC transceivers can be used herein without limitation.

After the POS station 104 obtains the article information, payment information is input into the retail transaction application of POS station 104. The payment information can include, but is not limited to, a customer loyalty code, payment card information, and/or payment account information. The payment information can be input manually, via an electronic card reader (e.g., a magnetic strip card reader), or via a barcode reader. Electronic card readers and barcode readers are well known in the art, and therefore will not be described herein. Any known or to be known electronic card reader and/or barcode reader can be used herein without limitation. The payment information can alternatively or additionally be obtained from a remote data store based on a customer identifier or account identifier. In this case, the payment information can be retrieved from stored data associated with a previous sale of an article to the customer.

Upon obtaining the payment information, the POS station 104 automatically performs operations for establishing a retail transaction session with the RTS 118. The retail transaction session can involve: communicating the article information and payment information from the POS station 104 to the RTS 118 via a public network 106 (e.g., the Internet); completing a purchase transaction by the RTS 118; and communicating a response message from the RTS 118 to the POS station 104 indicating that the article 102 has been successfully or unsuccessfully purchased. The purchase transaction can involve using an authorized payment system, such as a bank Automatic Clearing House ("ACH") payment system, a credit/debit card authorization system, or a third party system (e.g., PayPal®, SolidTrust Pay® or Google Wallet®).

Notably, the communications between the POS station 104 and computing device 108 of the RTS 118 may be secure communications in which cryptography is employed. In such scenarios, a cryptographic key can also be communicated from the POS station 104 to RTS 118, or vice versa. The cryptographic key can be a single use cryptographic key. Any type of cryptography can be employed herein without limitation.

The purchase transaction can be completed by the RTS 118 using the article information and payment information. In this regard, such information may be received by a computing device 108 of the RTS 118 and forwarded thereby to a subsystem of a private network 100 (e.g., an Intranet). For example, the article information and purchase information can also be forwarded to and processed by a purchase subsystem 112 to complete a purchase transaction. When the purchase transaction is completed, a message is generated and sent to the POS station 104 indicating whether the article 102 has been successfully or unsuccessfully purchased.

If the article 102 has been successfully purchased, then a security tag detaching process can be started. During the security tag detaching process, a security tag detacher 112 of the POS station 104 is used to cause actuation of a detaching mechanism of the security tag 132. Once the security tag 132 has been detached from article 102, the customer 140 can carry the article 102 through the surveillance zone without setting off the alarm.

Referring now to FIG. 2, there is provided a schematic illustration of the security tag 132 attached to an article 102. As noted above, the article 102 can include, but is not limited to, a heeled shoe. As such, the security tag 132 will be described below in relation to a heeled shoe. However, the present invention is not limited in this regard. The security tag can be used with other types of articles, which have adjacent portions including (1) a sidewall on which a clip can be attached and (2) a protrusion on which a securement member can be wrapped around. The securement member can be formed of a slender length of flexible material. As such, the securement member can include, but is not limited to, strap, a cable, a rope, or a lanyard.

As shown in FIG. 2, the security tag 132 is generally designed to be removably coupled to the counter 202 of the shoe (i.e., the vertical portion of the shoe that wraps around the back of the foot), without exerting excessive pressure or compression force on the shoe. In this regard, the security tag 132 comprises an engagement member 210 (e.g., a clip) designed to slidingly receive the counter 202 of the shoe so as to couple the security tag 132 thereto. The engagement member 210 will be described in more detail below. Still, it should be understood that engagement member 210 is configured such that a center axis (e.g., center axis 700 of FIG. 7) thereof is aligned or substantially aligned with a central axis (not shown in FIG. 2) of the counter 202 and/or a vertical seam (not shown in FIG. 2) of the counter 202. The engagement member 210 is also configured to have a portion shaped to mate or match the exterior profile of the counter 202, so as to minimize or eliminate any potential damage to the shoe by the security tag 132 and to ensure that the alignment between the security tag 132 and the counter 202 is maintained. The engagement member 210 is further configured to have a portion shaped as a shoehorn for allowing one to comfortably try on the shoe without distraction or annoyance from the security tag 132. Shoehorns are well known in the art, and therefore will not be described herein.

In some scenarios, the security tag 132 is designed to expel ink when a sensor (not shown) thereof detects an attempt to break the engagement member 210 and/or detects that the engagement member 210 has been broken. Various audio (e.g., an alarm), visual (e.g., light), and/or tactile indicators (e.g., vibration) can also be output from the security tag 132 when an unauthorized attempt is made to remove the security tag from the article, or from a particular geographical location. Also, a disposable cloth sleeve can be provided for removable disposition on the engagement member 210 so as to increase the cleanliness of the security tag when used to protect articles accessible by the general public.

As shown in FIG. 2, the security tag 132 also comprises a securement member 212 wrapped around the heel 204 of the shoe. The securement member 212 can include, but is not limited to, an adjustable strap, an adjustable cable, an adjustable rope, or an adjustable lanyard. In some scenarios, the portion of the securement member which wraps around the protrusion of the article comprises a soft fabric (e.g., felt) to ensure that damage will not be caused to the protrusion as a result of frictional contact therebetween. This soft fabric may encompass or exclusively define the portion of the securement member.

The securement member 212 is locked in its wrapped position (shown in FIG. 2) via a locking mechanism 214. The locking mechanism 214 will be described in detail below. Still, it should be understood that the locking mechanism 214 can include, but is not limited to, a wind-up type locking mechanism, a clamp type locking mechanism, a latch type locking mechanism, a pin type locking mechanism, a pin gear type locking mechanism, a tack-retainer type locking mechanism, or other fastener based locking mechanism. The locking mechanism 214 can be unlocked via a mechanical means or a magnetic means. Notably, this securement architecture of the security tag 132 ensures that any potential damage to the shoe by security tag 132 is minimized or eliminated. In this regard, it should be emphasized that the securement member 212 need not be excessively tightened to secure the security tag 132 to the shoe with a suitably high heel (e.g., >1 inch). As such, the securement member 212 is unlikely or less likely to cause frictional damage to the shoe.

Figure 3:
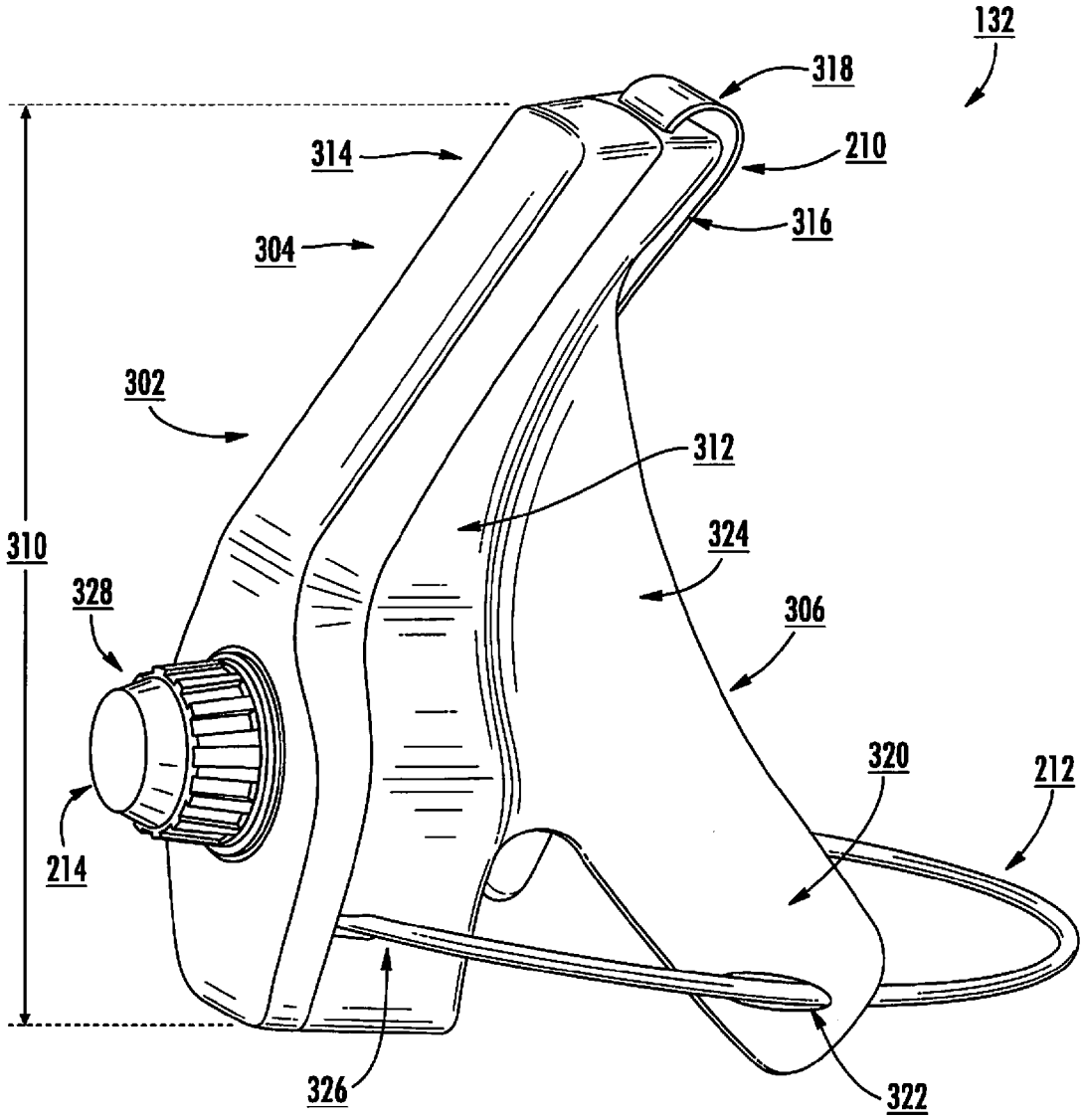
FIG. 3 is a right-rear perspective view of the security tag shown in FIG. 2 that is useful for understanding the present invention.
Figure 4:
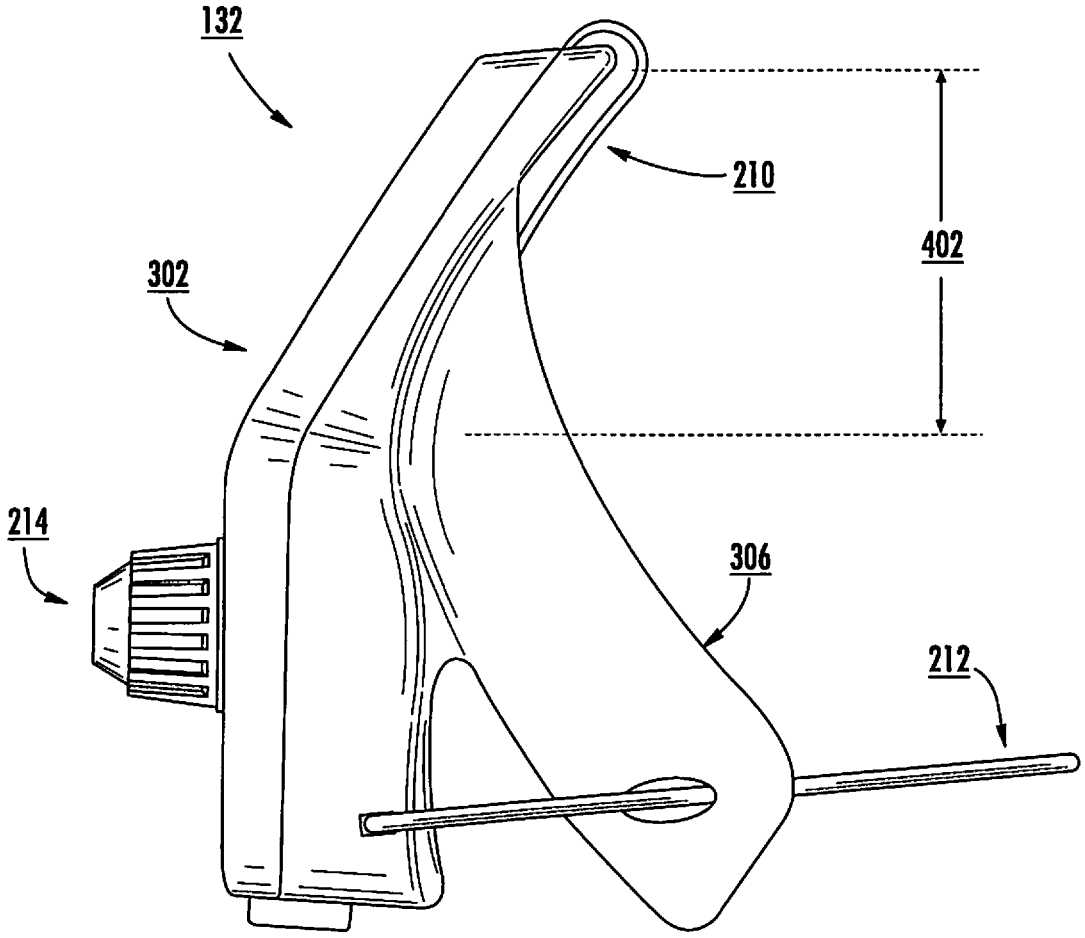
FIG. 4 is a right side view of the security tag shown in FIG. 2 that is useful for understanding the present invention.
Figure 5:
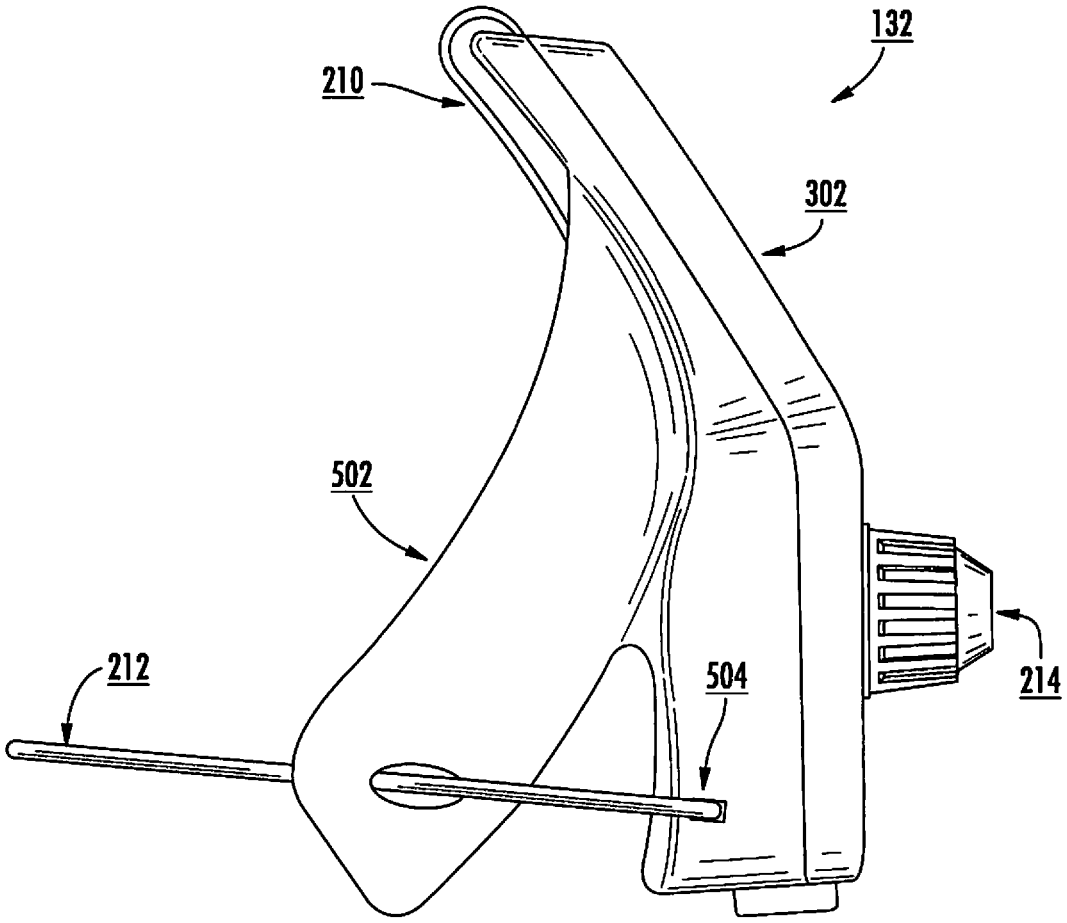
FIG. 5 is a left side view of the security tag shown in FIG. 2 that is useful for understanding the present invention.
Figure 6:
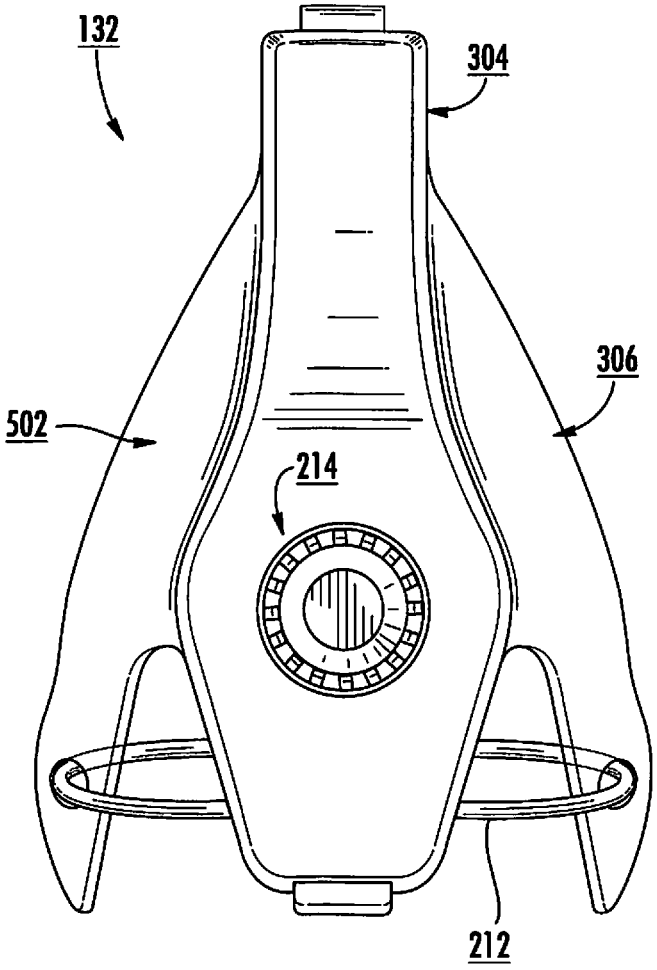
FIG. 6 is a rear view of the security tag shown in FIG. 2 that is useful for understanding the present invention.
Figure 7:
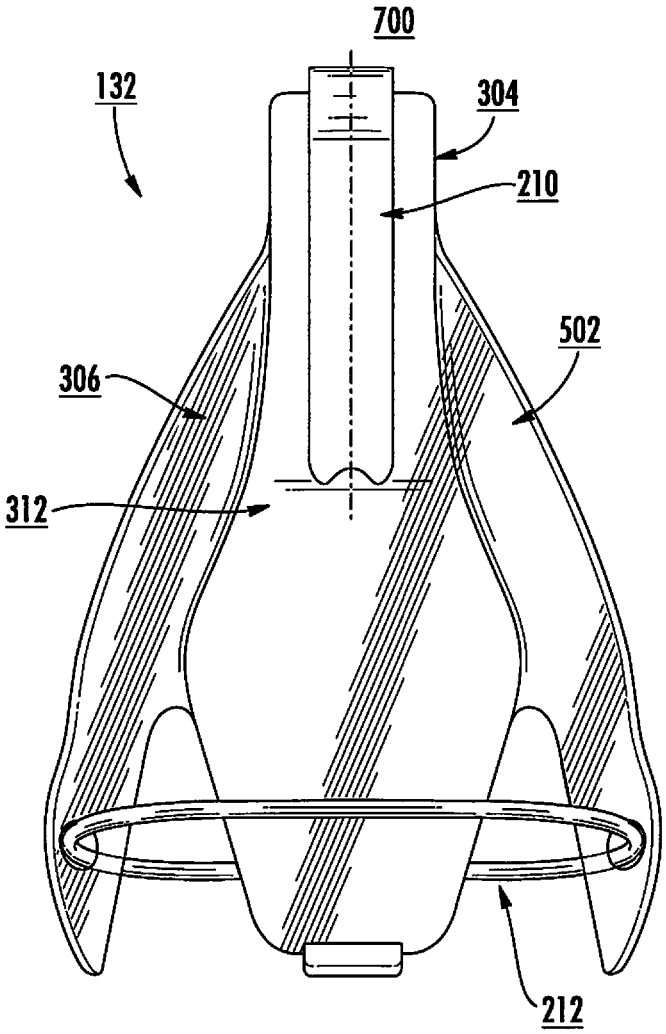
FIG. 7 is a front view of the security tag shown in FIG. 2 that is useful for understanding the present invention.

Although not shown in FIG. 3, the locking mechanism 214 and securement member 212 can alternatively be coupled to the remainder of the security tag via an articulating hinge. In this scenario, the locking mechanism 214 can be pulled by the securement member 212 towards the shoe 102 until an abutting arrangement is established between components 102 and 214. The abutting arrangement further facilitates the prevention of an unauthorized removal of the security tag 132 from the shoe 102 simply by rotation and/or lateral movement thereof.

As evident from FIG. 2, the security tag 132 is not overly visible. In this regard, it should be appreciated that the security tag 132 is attached to the back of the shoe, and therefore does not obstruct the front view or the side views of the shoe. Also, the security tag 132 can be at least partially formed from a transparent material (such as a clear plastic) so as to further minimize any obstruction of the shoe's appearance by the security tag. Embodiments of the present invention are not limited in this regard. The security tag 132 can alternatively be formed of an opaque material, such as an opaque plastic.

The security tag 132 will now be described in more detail in relation to FIGS. 3-8. The security tag 132 is shown in FIGS. 3-8 as being formed of a transparent material. As noted above, the invention is not limited in this regard. FIG. 3 is a right-rear perspective view of the security tag 132. A right side view of the security tag 132 is provided in FIG. 4. A left side view of the security tag 132 is provided in FIG. 5. A rear view of the security tag 132 is provided in FIG. 6. A front view of the security tag 132 is provided in FIG. 7. An assembly view of the security tag 132 is provided in FIG. 8.

As shown in FIGS. 3-8, security tag 132 comprises a housing 302 in which at least a portion of the locking mechanism 214 is housed. The housing 302 can be formed from any suitable materials, such as plastic. The material from which the housing 302 is formed may be transparent or opaque. However, there are many advantages to using transparent materials for the housing 302. For example, transparent materials facilitate the minimization of any obstruction of the article's appearance by the security tag 132.

Housing 302 is generally configured to align closely with the contours of a rear portion or counter 202 of a shoe. As such, housing 302 comprises a central body 304 formed of a rigid or semi-rigid material and configured to align with a vertical seam (not shown) of a shoe counter 202. In this regard, the central body 304 is sized and shaped to have a total height 310 approximately equal to the total height of the vertical seam of the shoe counter 202. At least a front surface 312 of the central body 304 is relatively smooth and contoured to follow the curve of the vertical seam. In this regard, the front surface 312 has a generally smooth concave contour. As such, damage is not caused to the shoe when the front surface 312 contacts the shoe counter 202 during use of the security tag 132. In some scenarios, at least one member (e.g., a rubber member) is provided on the front surface 312 to help prevent the rotation and/or linear movement of the housing 302 relative to the shoe.

In some scenarios, a security label 808 is also disposed within the central body 304 of the housing 302 or affixed to an exposed surface of the central body 304. Security labels are well known in the art, and therefore will not be described herein. Any known or to be known security label can be used herein without limitation. Still, it should be understood that the security label provides a way to detect when an article is being removed from a particular area by an unauthorized person(s) or in an unauthorized manner (e.g., without being purchased). As such, the security label includes a sensor operable with EAS technology. Such sensors can include, but are not limited to, an NFC sensor and/or an RFID sensor. In some scenarios, the security label is configured to provide an audible, visual and/or tactile alarm when its passes into the surveillance zone of an EAS system. An exemplary security label which can be used herein is the EAS Ultra•Max® narrow label sensor made by Sensormatic® Electronics Corporation.

The engagement member 210 is attached or coupled to the housing 302 at or near a top portion 314 of the housing's central body 304. In this regard, the engagement member 210 comprises a curved portion 318 configured to couple an elongate portion 316 to the housing 302. In some scenarios, the curved portion 318 has a generally U-shape or C-shape. Also, the elongate portion 316 is affixed to or is integrally formed with a curved top portion 318 of the engagement member 210. The elongate portion 316 extends along and is aligned with at least a portion of the front surface 312 of the central body 304. As such, the elongate portion 316 is in a mutually tensioned arrangement with the front surface 312 such that at least a portion of an article can be held or gripped therebetween (e.g., as shown in FIG. 2). In some scenarios, the elongate portion 316 (*a*) has a length 402 which is less than the length of the vertical seam of the shoe counter 202 and (*b*) is contoured to follow the curve of the interior surface of a shoe's counter 202. Accordingly, the interior of the shoe is not damaged by the elongate portion 316 when the security tag 132 is in use.

In some scenarios, the elongate portion 316 of the engagement member 210 comprises one or more segments sized and shaped substantially similar to or the same as a shoehorn. In this regard, each segment of the elongate portion 316 comprises a smooth curved implement that can be inserted at the heel of a foot to help a person put on the shoe. The elongate portion 316 can be formed of any suitable rigid, semi-rigid or flexible material, such as plastic or metal. In some scenarios, a soft material is disposed on the elongate portion 316 for improving the comfort level of a person trying on the shoe. Additionally or alternatively, a disposable cloth sleeve can be provided for removable disposition on the engagement member 210 so as to improve the comfort level of a person trying on the shoe, as well as increase the cleanliness of the security tag when used to protect articles accessible by the general public.

As shown in FIGS. 3-8, security tag 132 further comprises flanges 306, 502 coupled to and protruding in a direction away from respective sides of the housing's central body 304. The flanges 306, 502 are generally provided to maintain a position of the security tag 132 relative to a shoe to which the security tag 132 is attached. In some scenarios, the flanges 306, 502 are integrally formed with the housing's central body 304. In other scenarios, the flanges 306, 502 are coupled to the housing's central body 304 via snap type couplers or other releasable type couplers. This releasable flange configuration allows exchangeable different sized flanges to be used with the security, thereby expanding the number of articles to which the security tag can be attached.

The flanges 306, 502 can be formed of a semi-rigid material or a flexible material (e.g., a plastic or a rubber). The flanges 306, 502 are contoured to follow the shape of the corresponding portions of a shoe (e.g., as shown in FIG. 2), and are somewhat expandable outward relative to each other (i.e., expandable in a direction away from each other). In this regard, the flanges 306, 502 are symmetrically arranged with each other and curve towards each other so as to align closely with the contours of a shoe's counter 202 when the security tag 132 is attached to the shoe. Such a flange configuration ensures that damage will not be caused to the shoe by the flanges when the security tag 132 is attached thereto. A soft fabric (e.g., felt) may be provided on a portion of the flange surfaces to further ensure that damage will not be caused to the shoe by the flanges when the security tag 132 is attached thereto.

The flanges 306, 502 are sized and shaped to extend at least partially around the point of intersection of the shoe heel 204 and the shoe upper body 218, as shown in FIG. 2. This configuration ensures that the security tag 132 cannot be removed from the shoe simply by rotation thereof. At least one member (e.g., a rubber member) can be provided on a surface of each flange to further assist in the prevention of such rotation and/or linear movement of the security tag 132 relative to the shoe.

The respective distal end 320 of each flange 306, 502 includes an aperture 322 sized for insertion of the securement member 212 therethrough. In some scenarios, the distal end 320 of each flange curves outward or away from the security tag to minimize the amount of contact between the securement member 212 and the shoe 102. When the security tag 132 is attached to the shoe, the insertion of the securement member 212 through apertures 322 provides greater stability, making it less likely that the security tag 132 can be manipulated and removed from the shoe without unlocking the locking mechanism 214. Embodiments of the present invention are not limited to this aperture 322 configuration. For example, each flange 306, 502 can be alternatively or additionally designed with an elongate channel therethrough or along the bottom edge thereof sized for receiving the securement member 212.

The flanges 306, 502 can have any suitable configuration. Therefore, the overall shape of the flanges 306, 502 can be different from that shown in the figures. In the illustrated embodiment, the flanges 306, 502 are configured so that the overall profile of the security tag 132 is approximately triangular, with the widest portion 324 of the flanges 306, 502 being adjacent to the intersection of the shoe heel 204 and the shoe upper body 218, as shown in FIG. 2. In practice, it is desirable that the security tag 132 be constructed to be as visually unobtrusive to any onlooker as possible. The approximately triangular shape of the security tag 132 advantageously provides the necessary structure to secure the security tag 132 in place, while at the same time minimizing the areas of the shoe which are obscured from view by the security tag 132.

As noted above, the securement member 212 can include, but is not limited to, a strap, a cable, a rope, or a lanyard having any length sufficient for wrapping around at least a portion of an article (e.g., the heel 204 of a shoe) one or more times. In some scenarios, the securement member 212 has a first end 504 fixedly secured to the housing 302 and a second end 326 removable from the housing. In other scenarios, the first and/or second ends 326 are capable of being removed from or retracted into the housing 302. Such first/second end configurations allow the securement member 212 to be wrapped around a shoe heel 204 and tightened so as to secure the security tag 132 to the shoe.

Once the securement member 212 is wrapped around the shoe heel 204 and tightened, it can be locked in position by the locking mechanism 214. The locking mechanism 214 can include, but is not limited to, a wind-up type locking mechanism (as shown in FIGS. 2-8), a clamp type locking mechanism, a latch type locking mechanism, a cam type locking mechanism, a pin/tack type locking mechanism, and/or a pin gear type locking mechanism which is at least partially internal to the housing 302 and/or at least partially external to the housing 302. Examples of these various types of locking mechanisms which can be used with the present invention are described in U.S. Pat. No. 8,031,073 and U.S. Pat. No. 5,022,244.

An exemplary architecture for a wind-up type locking mechanism will be described below in relation to FIGS. 8-10. Still, it should be understood that in at least some of the wind-up lock scenarios the securement member 212 (e.g., a cable) is threaded through a wind-up locking mechanism. Both ends of the securement member 212 are secured within the locking mechanism to provide a closed loop having an adjustable diameter. A rotating knob (e.g., actuator 328 of FIG. 3) allows manual adjustment of the size of the closed loop, with the size of the loop being made smaller in one rotation direction of the knob and larger in the opposite rotation direction of the knob. The wind-up locking mechanism can include, but is not limited to, a wind-up locking mechanism disclosed in U.S. Pat. No. 7,918,112, U.S. Pat. No. 8,081,075, U.S. Pat. No. 8,087,269, U.S. Pat. No. 8,106,772, and/or U.S. Pat. No. 8,122,744. The entire disclosures of the listed patents are incorporated herein by reference. An exemplary architecture for a wind-up type locking mechanism will be described in detail below in relation to FIGS. 8-10.

An exemplary architecture for a latch type locking mechanism will be described below in relation to FIG. 11. Still, it should be understood that in at least some of the clamp and latch scenarios at least one loose end of the securement member 212 is retained between a pair of plates (which may or may not be disposed within the housing 302) or between a plate and a sidewall of the housing 302. The plates may have a smooth engagement surface or a rough engagement surface. The rough engagement surface can have teeth or protrusions formed thereon so as to provide a means for preventing a sliding removal of the securement member 212 from the clamp or latch. In this regard, the teeth/protrusions increase a frictional engagement or provide a mating engagement between the clamp and the securement member 212. Alternatively or additionally, the securement member 212 is retained between: a plate and a flat-head post. In this case, the plate, post and/or securement member 212 may have a series of teeth or protrusions formed on at least one end thereof so as to provide a means for preventing a sliding removal of the securement member 212 from the clamp or latch.

In the pin/tack and pin gear scenarios, the securement member 212 has one or more apertures formed through at least one end portion thereof for receiving the pin. When a pin is inserted into at least one aperture formed in the securement member 212, the securement member 212 is retained in position. An actuator 328 may be provided for longitudinally and/or laterally moving a pin/tack or rotating a pin gear such that at least one pin/tack can be removably inserted into the aperture formed in the securement member 212. The actuator 328 may comprise, but is not limited to, a rotatable knob, a pull-out knob, and/or a magnetic actuator. If the actuator 328 is a magnetic actuator, then the pin/tack of the locking mechanism 214 may be engaged with and/or disengaged from the securement member 212 via application of a magnetic field thereto.

Exemplary architectures for the various types of locking mechanism which can be used with the present invention will now be described in more detail. Schematic illustrations of a wind-up type locking mechanism 800 are provided in FIGS. 8-10. A schematic illustration of an exemplary latch type locking mechanism 1100 is provided in FIG. 11. Schematic illustrations of an exemplary magnetic cam type locking mechanism 1200 are provided FIGS. 12-13. Each of these different types of locking mechanisms will be discussed separately below.

Figure 8:
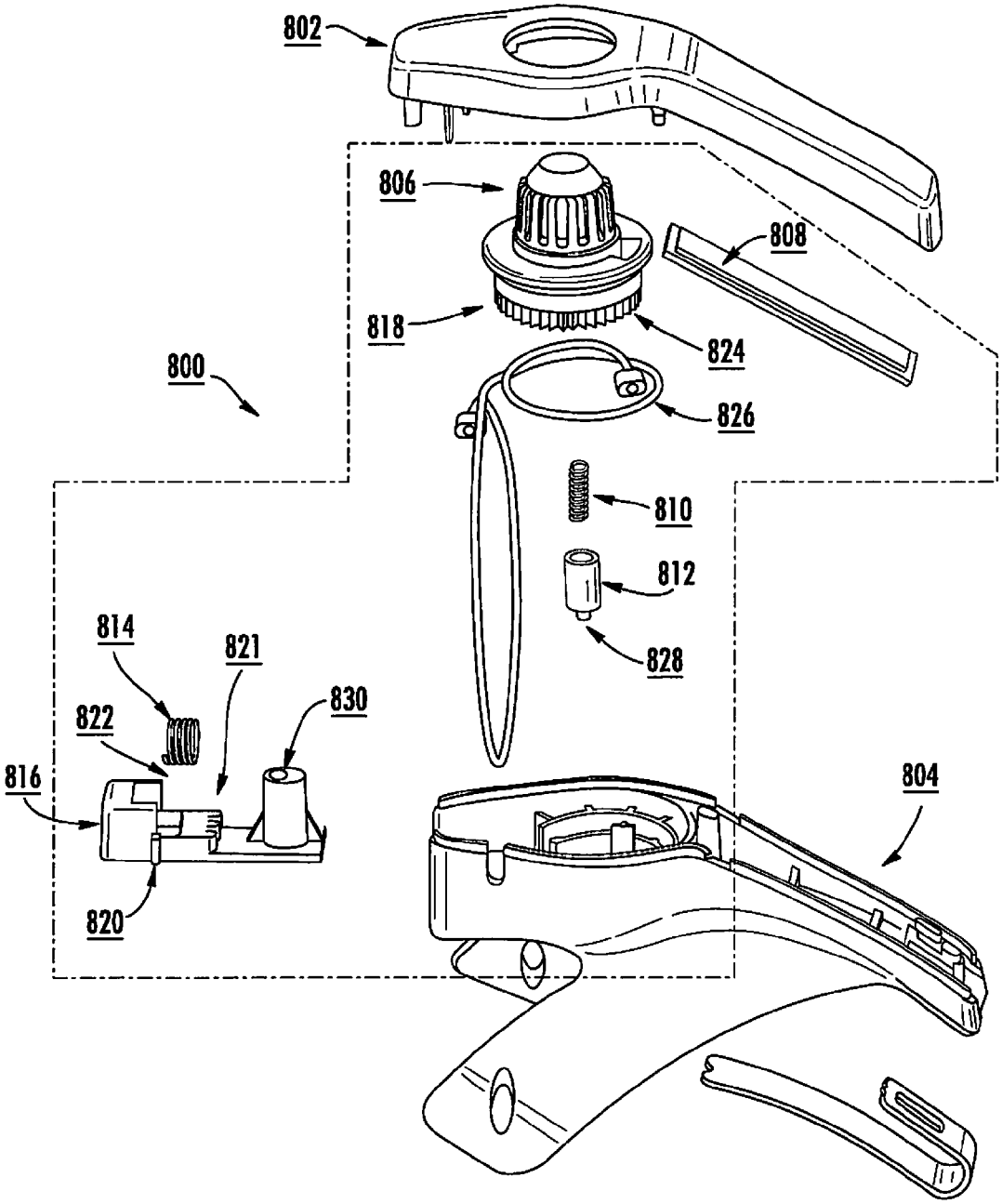
FIG. 8 is an assembly view of the security tag shown in FIG. 2 that is useful for understanding the present invention.
Figure 9:
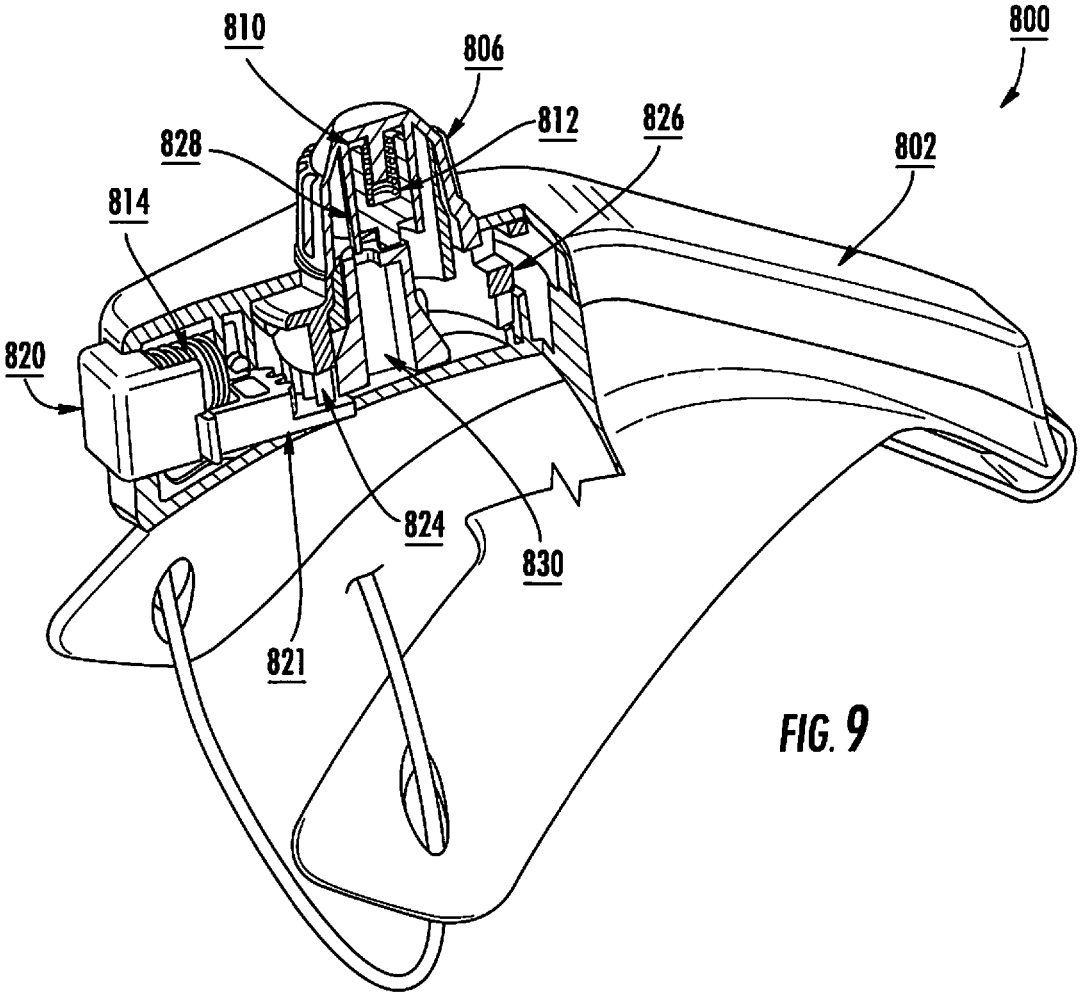
FIGS. 9-10 each provide a cut-away view of the wind-up type locking mechanism of FIG. 8 which is useful for understanding the operation thereof.
Figure 10:
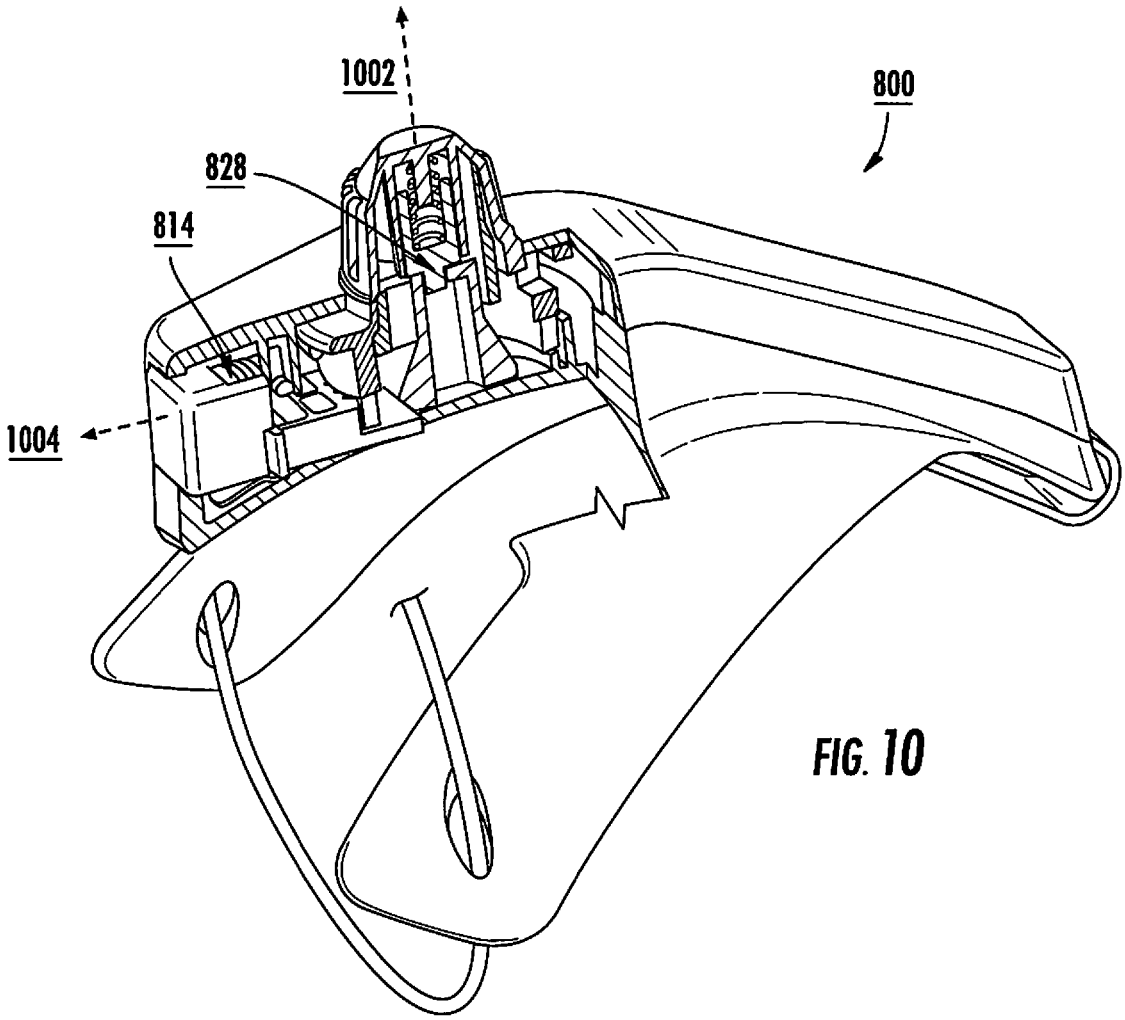

Referring now to FIGS. 8-10, the exemplary wind-up locking mechanism 800 is generally configured to allow the retention of a securement member (e.g., securement member 212 of FIGS. 2-8) within a security tag (e.g., security tag 132 of FIGS. 2-8) and the release of the security member from the security tag. Notably, the locking mechanism 214 is shown in FIGS. 2-8 to comprise a wind-up locking mechanism. The present invention is not limited in this regard. The locking mechanism 214 can be selected to include another type (e.g., such as those discussed below in relation to FIGS. 11-13) which is suitable for a particular application.

As shown in FIGS. 8-10, various components 806-816 of the locking mechanism 800 are at least partially disposed between a first cover 802 and a second cover 804, which can be coupled together to form a housing of the security tag (e.g., housing 302 of FIG. 3). The covers 802, 804 can be coupled together via a mechanical means and/or a chemical means. For example, the covers 802, 804 are ultrasonically welded together when the locking mechanism 800 is fully assembled. The various components include a knob 806, resilient members 810, 814, a magnetic plunger 812, and a button assembly 816. In some scenarios, the locking mechanism 800 further comprises an EAS label 808. In other scenarios, locking mechanism 800 is absent of the EAS label 808. EAS labels are well known in the art, and therefore will not be described herein. Still, it should be understood that the EAS label is generally configured to set off an alarm when it is activated and enters into an EAS surveillance zone.

The knob 806 is provided for allowing a user to rotate a gear wheel 818. The gear wheel 818 can be integrally formed with the knob 806 or attached to the knob 806 via a mechanical attachment means or a chemical attachment means. Rotation of the gear wheel 818 allows manual adjustment of the length of the securement member 826 (e.g., a cable) threaded through the locking mechanism 800. In this regard, it should be understood that both ends of the securement member 826 are secured within the locking mechanism 800 to provide a closed loop having an adjustable diameter. The knob 806 allows manual adjustment of the size of the closed loop, with the size of the loop being made smaller in one rotation direction and larger in the opposite rotation direction.

The button assembly 816 provides a means to retain the closed loop with a desired diameter. In this regard, the button assembly 816 includes a button 820 which is partially disposed within the housing 802, 804 and partially disposed outside the housing 802, 804. Button 820 is depressible by a user of the locking mechanism 800 so as to transition the button 820 between an unengaged position shown in FIG. 9 and an engaged position shown in FIG. 10. When the button assembly 816 is in its unengaged position, the knob 806 is rotatable. In contrast, knob 806 cannot be rotated when the button assembly 816 is in its engaged position. In this regard, it should be understood that teeth 821 are provided on a portion 822 of the button 820. The teeth 821 are configured to engage corresponding teeth 824 of the gear wheel 818 when the button 820 is depressed so as to be placed it in its engaged position. As a result of the engagement between teeth 821 and 824, the knob 806 is prevented from being rotated by a user of the locking mechanism 800.

Notably, when the button 820 is first placed in its engaged position, a post 828 of magnetic plunger 812 drops into a retention slot 830 of the button assembly 816, which prevents the teeth of the button assembly 816 and gear wheel 818 from disengaging until the magnetic plunger 812 is displaced in a direction shown by arrow 1002. The magnetic plunger 812 may be displaced using an external magnetic detacher (not shown) so as to overcome a force exerted by resilient member 810 on magnetic plunger 812. Resilient member 810 can include, but is not limited to, a spring.

Resilient member 814 is provided to facilitate the release of the button assembly 816 such that the teeth 821 of the button assembly 816 are disengaged from teeth 824 of the gear wheel 818, thereby allowing the knob 806 to be rotated. The button assembly 816 is released when the magnetic field is applied to the magnetic plunger 812, whereby resilient member 814 pushes the button 820 out and away from the housing 802, 804, i.e., in a direction shown by arrow 1004.

Figure 11:
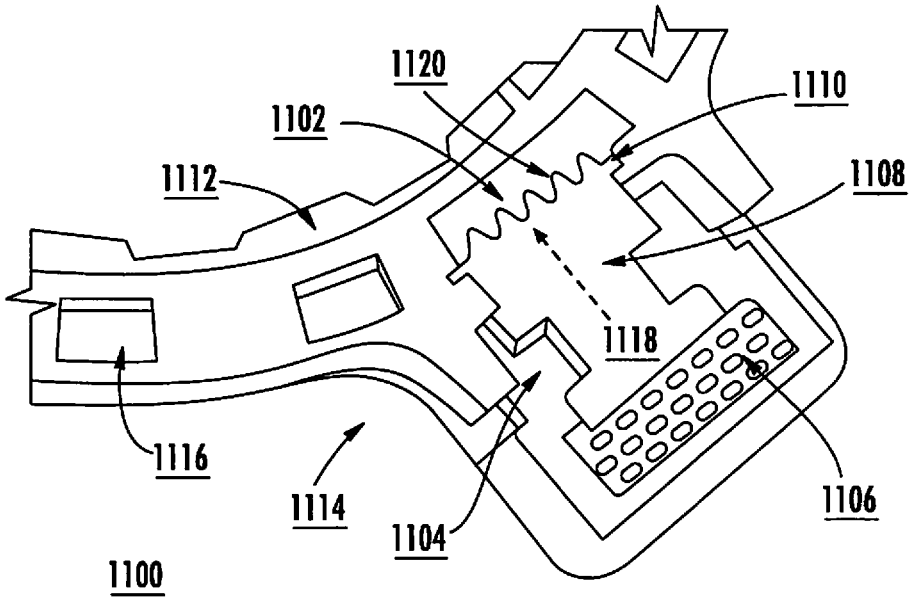
FIG. 11 is a schematic illustration of an exemplary latch type locking mechanism.

Referring now to FIG. 11, the exemplary latch type locking mechanism 1100 comprises a magnetically-actuable latch 1104. In this regard, latch 1104 is at least partially formed of a magnetic material. The magnetic material can include, but is not limited to, iron, nickel, cobalt, an alloy of iron, an alloy of nickel, and/or an alloy of cobalt.

The latch 1104 is configured to engage a securement member 1102 (e.g., a strap) so as to lock the securement member 1102 in position. This locking is at least partially achieved by moving the latch 1104 towards the securement member 1102 which is disposed in a channel 1116 formed in the housing 1114 of a security tag (e.g., security tag 132 of FIGS. 1-8). Stated differently, a body 1108 of the latch 1104 is moved in a direction of arrow 1118 until it engages the securement member 1102 and clamps the securement member 1102 between itself and a sidewall 1112 of the housing 1114. Notably, an engagement surface 1110 of latch 1104 and an engagement surface 1120 of the securement member 1102 have mating teeth or protrusions formed thereon. The teeth or protrusions can be angled against an insertion direction of the securement member 1102. These angled teeth or protrusions facilitate the securement of the securement member 1102 within the security tag in such a way that the securement member 1102 cannot be removed from the housing 1114 without unlocking the latch 1104, thereby thwarting attempts at forced extraction of the securement member 1102 from the locking mechanism 1100. Notably, the present invention is not limited to the mating teeth/protrusion configuration of the engagement surfaces 1110, 1120. Additionally or alternatively, the engagement surfaces 1110, 1120 can have ribs and/or mating holes and protrusions.

The latch body 1108 is biased into its locking position via a flexible element 1106. The flexible element 1106 may have any shape suitable for a particular application. For example, the flexible element 1106 can have a generally cuboid, ellipsoid, or coil shape. In some scenarios, the flexible element 1106 is a cantilever arm (e.g., a leaf spring). The flexible element 1106 can be formed from a flexible material. The flexible material can include, but is not limited to, a light, porous, semi-rigid, elastic, gaseous, and/or spongy material that may provide a resistant force when compressed and may partially or fully recover its uncompressed shape when the compressive force is removed.

The latch 1104 is unlocked using a detacher device (not shown in FIG. 12), such as that disclosed in U.S. Pat. No. 8,031,073 (the entire disclosure of which is incorporated herein by reference). In some scenarios, the detacher device includes at least one magnet for creating a magnetic field having sufficient strength to move the latch body 1108 in a direction opposed to the direction shown by arrow 1118. In this regard, the magnet is selected to provide a sufficient magnetic force to overcome the biasing force of the flexible element 1106. When the latch body 1108 is moved in this way, the latch 1104 is unlocked such that the securement member 202 can be at least partially withdrawn from the housing 1114.

An exemplary magnetic cam type locking mechanism 1200 will now be discussed in relation to FIGS. 12-13. The locking mechanism 1200 is configured to secure the securement member 1202 (e.g., a cable) in its locked position shown in FIG. 12. In the regard, the locking mechanism 1200 comprises a housing 1204 in which various components thereof are disposed. The housing 1204 may be integrally formed with a housing of a security tag (e.g., security tag 132 of FIGS. 1-8) or attached to the security tag housing via a mechanical and/or chemical attachment means (e.g., a screw, a weld, and/or glue).

The locking mechanism 1200 comprises an eccentric cam wheel 1206 rotatably mounted on a pivot member 1208. In the locked position, the securement member 1302 is compressed between a flange 1250 of the cam wheel 1206 and a retaining member 1210. The flange 1250 is shown in FIGS. 12-13 as extending only partially around the can wheel 1206. Embodiments of the present invention are not limited in this regard. The cam wheel 1206 has ridges (or protrusions) 1212 formed on an engagement surface 1214 thereof. The ridges 1212 contact the securement member 1202 when in the locked position so as to securely grip the securement member 1202, thereby providing a means to thwart attempts at forced extraction of the securement member 1202 from the locking mechanism 1200. The ridges 1212 also guide the cable inwardly (i.e., in the opposite direction shown by arrow 1260) into the locking mechanism 1200 during insertion into the security tag (e.g., security tag 132 of FIGS. 1-8). In alternative scenarios, the cam wheel 1206 is absent of the ridges. As such, the contact between the securement member 1202 and the cam wheel 1206 is a frictional contact which is sufficient for the causing the cam wheel to rotate when the securement member is pulled in the direction shown by arrow 1260.

The locking mechanism 1200 also comprises a latch assembly 1216 for locking the securement member and cam wheel in their fully engaged position. The latch assembly 1216 includes a magnetic element 1218 contained in a housing 1220. The housing 1220 is movable in two opposing directions shown by arrows 1222 and 1302, such that the latch assembly 1216 can be transitioned between a locked position (shown in FIG. 12) and an unlocked position (shown in FIG. 13). The latch assembly 1216 is transitioned between its locked and unlocked positions via a resilient member 1224. Resilient member 1224 can include, but is not limited to, a spring formed of any material with an elasticity selected in accordance with a particular application. The latch assembly 1216 is transitioned from its locked position to its unlocked position when a magnetic field is applied thereto. When a magnetic field is applied to the locking mechanism 1200, the magnetic element 1218 overcomes the bias force of the resilient member 1224 to move the latch assembly 1216 in the direction shown by arrow 1302. Accordingly, the resilient member 1224 is in a compressed state when the latch assembly 1216 is biased in the locked position, and an uncompressed state when the latch assembly 1216 is in the unlocked position.

A locking element 1228 is attached to the cam wheel 1206 so as to extend radially outward therefrom. The locking element 1228 resides between two detents 1230, 1232 extending outwardly from housing 1220. The detents 1230, 1232 can be integrally formed with the housing 1220 or attached to the housing via a mechanical or chemical coupling means (e.g., a weld or glue). During a locking process (i.e., when a magnetic field is not being applied to the locking mechanism 1200), the detents 1230, 1232 contact the locking element 1228 and apply a force thereto so as to rotate the cam wheel 1206 in a direction shown by arrow 1234.

Detent 1232 has an angled engagement surface 1236 for engaging the locking element 1228. The engagement surface 1236 is angled to be approximately parallel to a surface 1238 of the locking element 1228 when the cam wheel 1206 is in its locked position, as shown in FIG. 12. The angled engagement surface 1236 serves to maintain the cam wheel 1206 in a locked position in which the ridges 1212 compress the securement member 1202 between the cam wheel 1206 and the retaining member 1210. A gap 1240 exists between surfaces 1236, 1238 when the locking mechanism 1200 in the locked position. The gap 1240 enables the locking element 1228 to rotate a certain distance before it contacts surface 1236 of the detent 1232.

When the securement member 1202 (e.g., a cable) is urged further into the locking mechanism 1200, the cam wheel 1206 rotates slightly until the locking element 1228 contacts detent 1232. This action causes the ridges 1212 to pull the securement member 1202 inwardly. If the securement member 1202 is pulled outwardly, the ridges 1212 act on the securement member 1202 so as to rotate the cam wheel 1206 in the opposite direction. In this scenario, the rotation of the locking element 1228 is arrested by contact with the securement member 1202, and the securement member 1202 is once again compressed between the cam wheel 1206 and the retaining member 1210. This arrangement advantageously allows further insertion of the securement member 1202 (e.g., a cable) to tighten slack in the securement member 1202 (e.g., a cable), while the device is locked and while preventing extraction of the securement member 1202.

Figure 12:
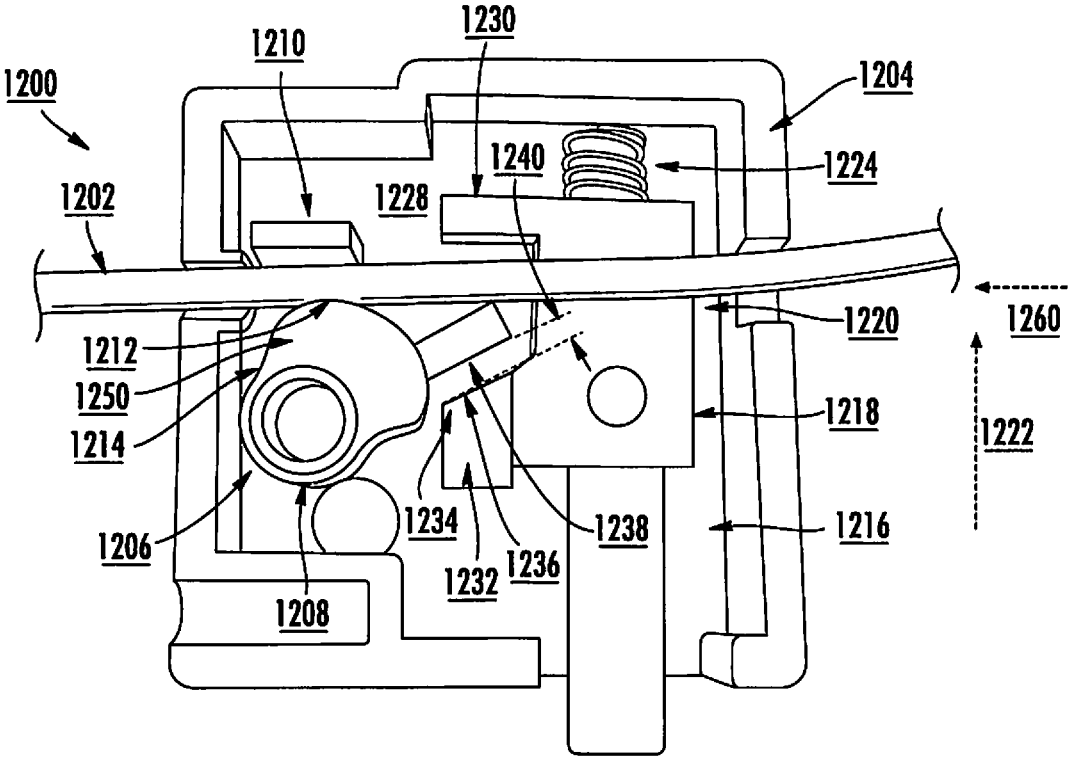
FIGS. 12-13 each provide a schematic illustration of an exemplary magnetic cam locking mechanism.
Figure 13:
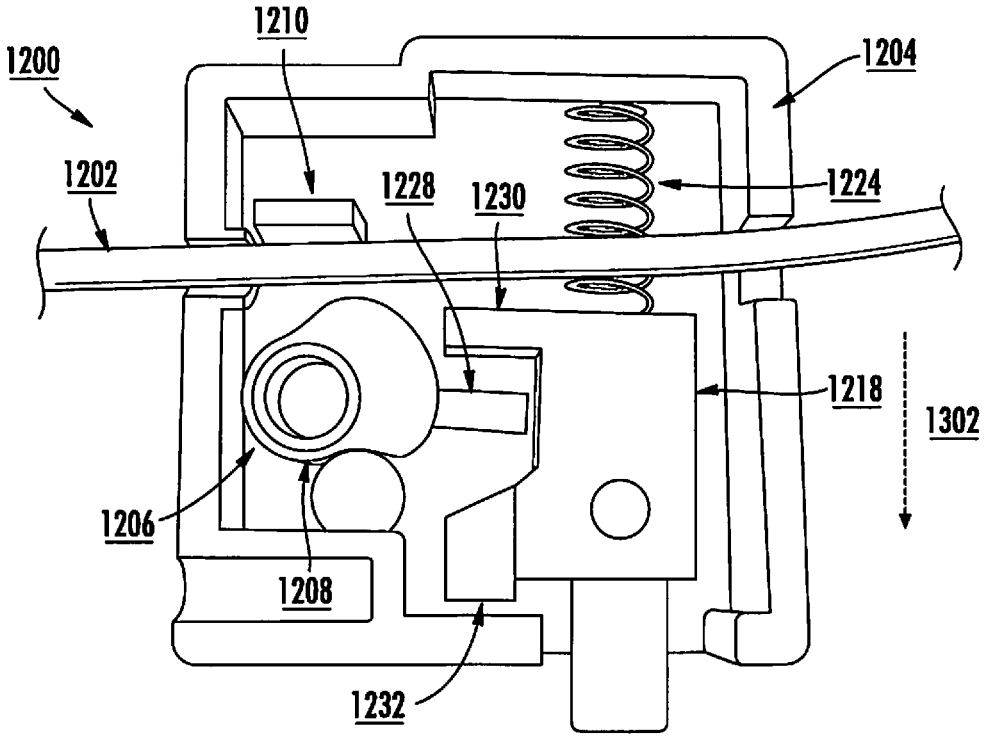

The locking mechanism 1200 is unlocked using a detacher device (not shown in FIGS. 12-13). The detacher device comprises a magnet for moving the latch assembly 1216 in the direction shown by arrow 1302 until detent 1230 rotates cam wheel 1206 to a position which permits extraction of the securement member 1202. A schematic illustration of the locking mechanism 1200 in its unlocked position is provided in FIG. 13.

The present invention is not limited to the architecture of locking mechanism 1200 shown in FIGS. 12-13. The locking mechanism 1200 can have any suitable design selected in accordance with a particular application. Accordingly, the locking mechanism 1200 can alternatively comprise a magnetically-actuable ball clutch locking arrangement.

Figure 14:
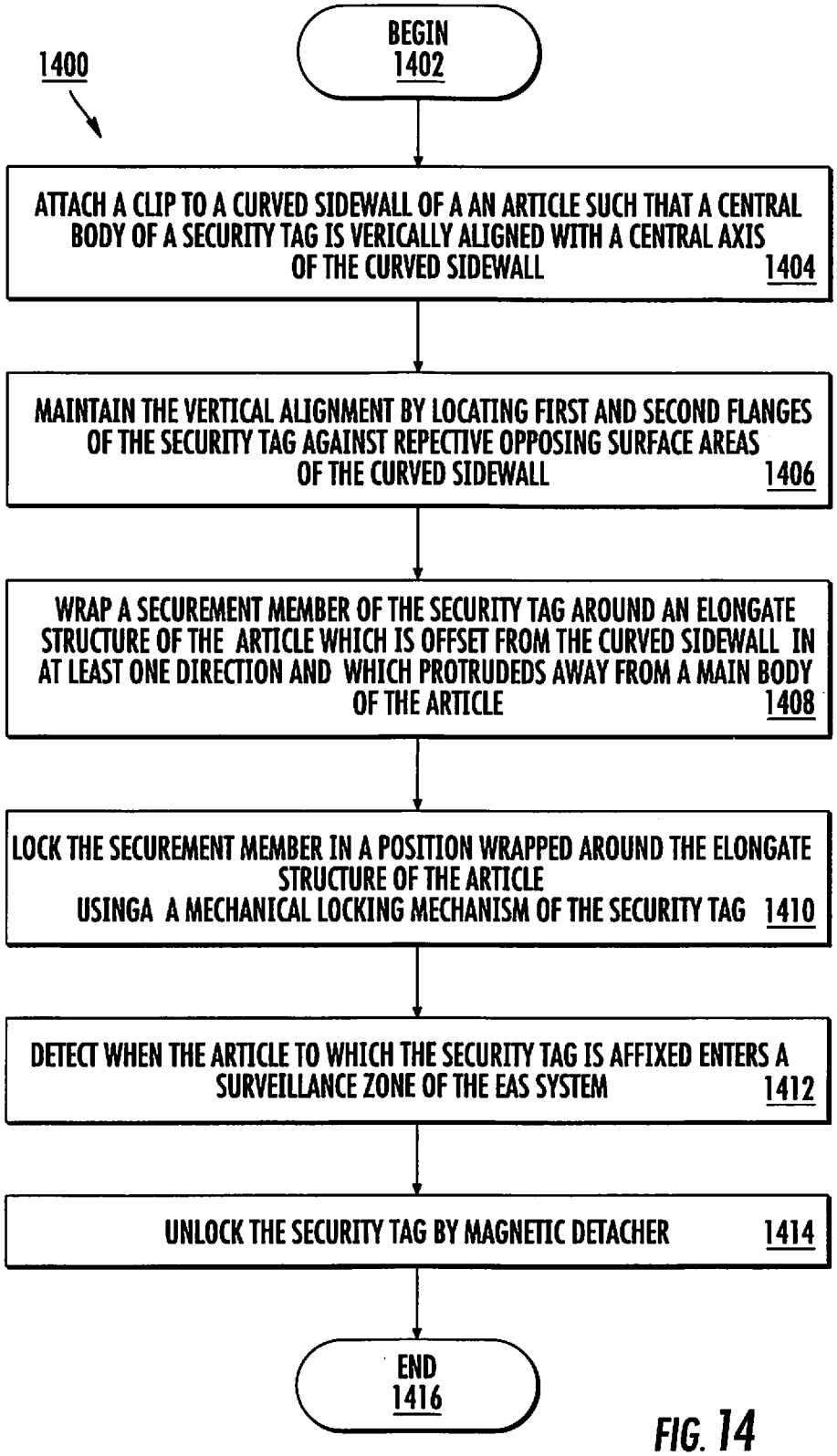
FIG. 14 is a flow diagram of an exemplary method for operating a security tag of an EAS system.

Referring now to FIG. 14, there is provided a flow diagram of an exemplary method 1400 for operating a security tag of an EAS system. Method 1400 begins with step 1402 and continues with step 1404. Step 1404 involves attaching a clip to a curved sidewall of an article (e.g., a counter of a heeled shoe) such that a central body of the security tag is vertically aligned with a central axis of the curved sidewall. The vertical alignment is maintained by locating first and second flanges of the security tag against respective opposing surface areas of the curved sidewall, as shown by step 1406. The first and second flanges extend away from respective sides of the central body so as to be symmetrical to one another, and are shaped to align closely with an exterior contour of the respective surface areas of the curved sidewall. Next in step 1408, a securement member of the security tag is wrapped around an elongate structure of the article (e.g., a shoe heel). The elongate structure is offset from the curved sidewall in at least one direction and protrudes away from a main body of the article. The securement member is formed of a slender length of flexible material. Subsequently, the securement member is locked in a position wrapped around the elongate structure of the article using a mechanical locking mechanism of the security tag, as shown by step 1410. Once the security tag is secure to the article, the security tag can facilitate the detection of the article within a surveillance zone of the EAS system, as shown by step 1412. At some later time, step 1414 is performed where the mechanical locking mechanism is unlocked by applying a magnetic field thereto. In next step 1416, method 1400 ends.

All of the apparatus, methods and algorithms disclosed and claimed herein can be made and executed without undue experimentation in light of the present disclosure. While the invention has been described in terms of preferred embodiments, it will be apparent to those of skill in the art that variations may be applied to the apparatus, methods and sequence of steps of the method without departing from the concept, spirit and scope of the invention. More specifically, it will be apparent that certain components may be added to, combined with, or substituted for the components described herein while the same or similar results would be achieved. All such similar substitutes and modifications apparent to those skilled in the art are deemed to be within the spirit, scope and concept of the invention as defined.

We claim:

1. A method for operating a security tag of an Electronic Article Surveillance ("EAS") system, comprising:

attaching a clip to a curved sidewall of an article such that a central body of the security tag is vertically aligned with a central axis of the curved sidewall;

maintaining the vertical alignment by locating first and second flanges of the security tag against respective opposing surface areas of the curved sidewall, the first and second flanges extending away from respective sides of the central body so as to be symmetrical to one another and shaped to align closely with an exterior contour of the respective surface areas of the curved sidewall;

wrapping a securement member of the security tag around an elongate structure of the article which is offset from the curved sidewall in at least one direction and which protrudes away from a main body of the article, the securement member formed of a slender length of flexible material; and locking the securement member in a position wrapped around the elongate structure of the article using a mechanical locking mechanism of the security tag.

2. The method according to claim 1, wherein the article comprises a shoe, the curved sidewall defines a counter of the shoe, and the elongate structure comprises a heel of the shoe.

3. The method according to claim 1, further comprising providing a shoehorn at least partially defining the clip attaching the security tag to the article.

4. The method according to claim 1, further comprising unlocking the mechanical locking mechanism by applying a magnetic field thereto.

5. The method according to claim 1, wherein the security tag is at least partially formed of a transparent material.

6. The method according to claim 1, further comprising detecting when the article to which the security tag is affixed enters a surveillance zone of the EAS system.

7. A security tag for use in an Electronic Article Surveillance ("EAS") system, comprising:

a central body;

a clip coupled to the central body and configured to be attached to a curved sidewall of an article such that the central body is vertically aligned with a central vertical axis of the curved sidewall;

first and second flanges configured to maintain the vertical alignment when located against respective opposing surface areas of the curved sidewall, the first and second flanges extending away from respective sides of the central body so as to be symmetrical to one another and shaped to align closely with an exterior contour of the respective surface areas of the curved sidewall;

a securement member formed of a slender length of flexible material coupled to the first and second flanges such that the securement member may be wrapped around an elongate structure of the article which is offset from the curved sidewall in at least one direction and which protrudes away from a main body of the article; and a mechanical locking mechanism configured to lock the securement member in a position wrapped around the elongate structure of the article.

8. The security tag according to claim 7, wherein the article comprises a heeled shoe, the curved sidewall defines a counter of the shoe, and the elongate structure comprises a heel of the shoe.

9. The security tag according to claim 8, wherein the central body has a total height approximately equal to a total height of a vertical seam of the counter.

10. The security tag according to claim 8, wherein the central body comprises a concave surface contoured to follow a curve of the vertical seam.

11. The security tag according to claim 7, wherein at least a portion of the clip comprises a shoehorn.

12. The security tag according to claim 7, wherein the clip comprises a curved portion that is coupled to a first end of the central body opposed from a second end of the security tag to which the securement member is coupled.

13. The security tag according to claim 12, wherein the clip further comprises an elongate portion coupled to and extending from the curved portion so as to be adjacent to and parallel with an exterior surface of the central body.

14. The security tag according to claim 13, wherein the elongate portion is in mutually tensioned arrangement with the exterior surface of the central body such that the sidewall of the article can be gripped therebetween.

15. The security tag according to claim 7, wherein the first and second flanges are integrally formed with the central body.

16. The security tag according to claim 7, wherein the first and second flanges are sized and shaped to extend at least partially around a point of intersection of the elongate structure and sidewall of the article.

17. The security tag according to claim 7, further comprising at least one aperture formed in each of the first and second flanges through which the securement member passes.

18. The security tag according to claim 7, wherein the mechanical locking mechanism is configured to be unlocked by an application of a magnetic field thereto.

19. The security tag according to claim 7, wherein the security tag is at least partially formed of a transparent material.

20. The security tag according to claim 7, further comprising a security label configured to cause an alarm to be activated when the article to which the security tag is affixed enters a surveillance zone of the EAS system.

* * * * *